US005394792A

United States Patent [19]

Satake et al.

[11] Patent Number: 5,394,792

[45] Date of Patent: Mar. 7, 1995

[54] BRAN-REMOVING PERFORATED CYLINDRICAL BODY OF ABRASIVE TYPE GRAIN MILLING MACHINE

[75] Inventors: Satoru Satake, Tokyo; Yutaka Okada; Shigeru Ariji, both of Higashihiroshima, all of Japan

[73] Assignee: Satake Corporation, Tokyo, Japan

[21] Appl. No.: 274,981

[22] Filed: Jul. 13, 1994

[30] Foreign Application Priority Data

Sep. 7, 1993 [JP] Japan ..... 5-247557

[51] Int. Cl.[6] ..... B02B 3/00; B02B 3/04; B02B 3/06; B02B 7/02

[52] U.S. Cl. ..... 99/519; 99/523; 99/524; 99/528; 99/606; 99/607; 99/609; 99/617

[58] Field of Search ..... 99/518–525, 99/528, 600–602, 605–608, 609, 612–615, 617, 620, 622; 426/481–483; 51/4, 22, 72 R, 307–309; 241/57, 58, 74, 257.1, 260.1

[56] References Cited

U.S. PATENT DOCUMENTS

| | | | |
|---|---|---|---|
| 263,195 | 8/1882 | Morgan | 99/607 |
| 414,431 | 11/1889 | Morse | 99/519 |
| 1,100,190 | 6/1914 | Lund et al. | 99/606 |
| 1,221,855 | 4/1917 | Hicks | 99/617 |
| 1,525,398 | 2/1925 | Kemp | 99/607 |
| 1,624,831 | 4/1927 | Geddes | 99/607 |
| 2,360,411 | 10/1944 | Frova | 99/544 |
| 2,635,309 | 4/1953 | Smith | 99/519 |
| 3,628,582 | 12/1971 | Satake | 99/617 |
| 3,960,068 | 6/1976 | Salete | 99/606 |
| 4,843,957 | 7/1989 | Satake | 99/519 |
| 5,295,629 | 3/1994 | Satake et al. | 241/57 |

FOREIGN PATENT DOCUMENTS

| | | |
|---|---|---|
| 29-3216 | 9/1927 | Japan . |
| 36-19981 | 12/1935 | Japan . |
| 54-3098 | 2/1979 | Japan . |

*Primary Examiner*—Timothy F. Simone
*Attorney, Agent, or Firm*—Darby & Darby

[57] ABSTRACT

An abrasive type vertical grain milling machine comprises a perforated cylindrical body having at least one perforated arcuate plate member which is formed therein with both a first group of elongated bran-removing holes serving to lead grain to be milled in a direction from an inlet side toward an outlet side of a grain milling chamber when the grain is rotated in the direction of rotation of a grain milling roll assembly within the grain milling chamber and a second group of elongated bran-removing holes serving to lead the grain to be milled in a direction from the outlet side toward the inlet side of the grain milling chamber when the grain is rotated in the direction of rotation of the grain milling roll assembly within the grain milling chamber, and therefore, grain can be milled highly efficiently and the progress of breakage of grains caused at the time of grain milling can be suppressed.

8 Claims, 7 Drawing Sheets

BRAN-REMOVING PERFORATED CYLINDRICAL BODY OF ABRASIVE TYPE GRAIN MILLING MACHINE

FIELD OF THE INVENTION

The present invention relates to a vertical grain milling machine in which grain to be milled is introduced into a cylindrical grain milling chamber from vertical one end of the grain milling chamber and grain having been milled is discharged from the other end of the same, and more particularly, to an abrasive type vertical grain milling machine of the type that comprises a abrasive roll assembly mounted on a main shaft extending straight in the vertical direction and a perforated or porous cylindrical body or cylindirical screen extending vertically around the roll assembly leaving a space therefrom so as to form the cylindrical grain milling chamber around the roll assembly in cooperation with an outer peripheral surface of the roll assembly and having a large number of bran-removing holes or perforations through which bran produced in the grain milling chamber is allowed to be released so that the grain to be milled is introduced into the grain milling chamber from vertical one end of the grain milling chamber and the grain having been milled is discharged from the other end of the same. The invention especially relates to the bran-removing perforated or porous cylindrical body of the abrasive type vertical grain milling machine.

It is noted that grain to be milled is not limited to rice grain but may be other cereal grain such as wheat grain or coffee bean.

DESCRIPTION OF RELATED ARTS

As described later in connection with FIG. 6, there has conventionally been known an abrasive type vertical grain milling machine in which a cylindrical body or screen comprises for example two or four perforated or porous arcuate plate members having bran-removing perforations or holes formed therein and, in order to lead grain to be milled in a direction from one end toward the other end of a grain milling chamber when the grain is rotated within the grain milling chamber in the direction of rotation of a grain milling roll assembly, each of the bran-removing holes being an elongated hole extending inclinedly in the direction of rotation of the grain milling roll assembly as going from one end toward the other end of the grain milling chamber.

In this kind of grain milling machine, the bran-removing holes substantially serve to feed uniformly the grain to be milled toward the downstream side.

Further, there has been also known an abrasive type vertical grain milling machine in which the perforated or porous cylindrical body comprises the perforated arcuate plate members formed with the bran-removing holes and each of the bran-removing holes being an elongated hole extending inclinedly such that, when the grain to be milled is rotated within the grain milling chamber in the direction of rotation of the grain milling roll assembly, the grain is deflected or led upwards against the direction in which the grain flows down toward a discharge port of the grain milling chamber so as to make the grain layer have a tendency to receive a lifting or raising force, as disclosed in Japanese Patent Examined Publication No. 36-19981.

In this grain milling machine, every bran-removing hole inclined in the reverse direction serves to apply the lifting or raising force to the grain layer or to feed or send back substantially the grain to be milled toward the upstream side so as to make the grain density uniform in both upstream and downstream regions to activate substantially the movement of grain for the purpose of improving the milled grain yield.

Further, Japanese Patent Examined Publication No. 29-3216 discloses an abrasive type vertical grain milling machine in which a perforated or porous wall is so formed as to have a plurality of inverted truncated cone-shaped portions in the vertical direction instead of being formed in a cylindrical shape so as to push back the grain upwards by making use of the inverted truncated cone-shaped portions.

However, in any of the above grain milling machines, at least one of points, that is, a grain milling power or capacity (speed), a yield of grain obtained by the grain milling without being broken, and ease of production and maintenance of the grain milling machine cannot always be sufficiently satisfactory.

Moreover, as disclosed for example in Japanese Patent Examined Publication No. 54-3098 and U.S. Pat. No. 3,960,068 corresponding thereto, there has been also known a vertical grain milling machine, though it is of friction type, in which knives serving as resistance members are provided between the circumferentially adjacent edge portions of the perforated porous arcuate plate members (for the drum screen), each knife extending in the vertical direction while being projected radially inwardly so as to impart a resistance to the motion of grain in the circumferential direction of the roll assembly, and an amount of projection of the knives being adjustable.

However, the resistance member of this grain milling machine is not intended to act to send back the grain toward the upstream side.

SUMMARY OF THE INVENTION

The present invention was developed in view of the various points described above and an object of the invention is to provide an abrasive type vertical grain milling machine which is capable of milling grains highly efficiently as well as of suppressing the progress of crushing or breakage of grain caused at the time of grain milling.

According to the present invention, the above object can be achieved by an abrasive type vertical grain milling machine in which the perforated or porous cylindrical body is formed by at least one perforated or porous arcuate plate member having bran-removing holes therein, and the bran-removing holes include a first group of elongated bran-removing holes which serve to lead or guide the grain to be milled in a direction from the one end toward the other end of the grain milling chamber when the grain is rotated in the direction of rotation of a grain milling roll assembly within the grain milling chamber and a second group of elongated bran-removing holes which serve to lead or guide the grain to be milled in a direction from the other end toward the one end of the grain milling chamber when the grain is rotated in the direction of rotation of the grain milling roll assembly within the grain milling chamber.

In the abrasive type vertical grain milling machine according to the present invention, the perforated arcuate plate members constituting the perforated cylindrical body are formed therein with the first group of elongated bran-removing holes which serve to lead the grain to be milled in the direction from the one end toward the other end of the grain milling chamber when the grain is rotated in the direction of rotation of the grain milling roll assembly within the grain milling chamber, and therefore, it is ensured that the grain can be milled as it is fed in the direction of its general flow, that is, in the direction going from the one end toward the other end of the grain milling chamber and in the direction of rotation of the grain milling roll assembly as a whole over a wide range or region within the grain milling chamber. Further, in the abrasive type vertical grain milling machine according to the present invention, the perforated arcuate plate members constituting the perforated cylindrical body are formed therein not only with the first group of elongated bran-removing holes but also with the second group of elongated bran-removing holes which serve to lead the grain to be milled in the direction from the other end toward the one end of the grain milling chamber when the grain is rotated in the direction of rotation of the grain milling roll assembly within the grain milling chamber, and therefore, the second group of bran-removing holes tend to lead the grain in the direction different from the direction of the general or overall flow of the grain within the grain milling chamber, that is, in the direction going from the other end toward the one end of the grain milling chamber and in the direction of rotation of the grain milling roll assembly, with a result that turblence or stirring of grains is promoted over the wide range or region within the grain milling chamber and that the resistance to the general or average follow of the grains is produced. Therefore, the grain milling can be made to proceed uniformly in the whole grain milling chamber. In consequence, since it is ensured to perform the grain milling without giving excessively powerful grain milling action to the grain in the grain milling chamber, it is possible to suppress the crushing or breakage of grain caused at the time of grain milling in the grain milling chamber.

According to a preferred embodiment of the present invention, each of the first group of elongated bran-removing holes is formed to extend inclinedly along a first leading or guiding direction so as to lead or guide the grain to be milled in the direction from the one end toward the other end of the grain milling chamber when the grain is rotated in the direction of rotation of the grain milling roll assembly within the grain milling chamber, while each of the second group of elongated bran-removing holes is formed to extend inclinedly along a second leading or guiding direction different from the first leading or guiding direction so as to lead or guide the grain to be milled in the direction from the other end toward the one end of the grain milling chamber when the grain is rotated in the direction of rotation of the grain milling roll assembly within the grain milling chamber.

In this case, since the grains are led more or less in the directions in which the first and second groups of elongated bran-removing holes extend respectively, by suitably setting the distribution of the first and second groups of bran-removing holes, it is possible to provide turbulence and resistance appropriately.

According to the present invention, preferably, number of the second group of holes is considerably smaller than that of the first group of holes.

In this case, it is ensured that the direction of general flow of the grain can be controlled by the first group of holes and, under this condition, the second group of holes can lead the grain in the different direction more effectively.

According to the present invention, it is preferred that the second group of holes are distributed between the first group of holes as being collected by plural holes. For example, the second group of holes are distributed between the first group of holes as being collected three by three in the vertical direction.

In this case, although each individual bran-removing hole is small enough to prevent the grain from passing therethrough, the second group of holes thus collected together can have an effect of providing large turbulence and a resistance as a whole.

Further, one or more vertical lines of the second groups of holes may be distributed between associated vertical lines of the first group of holes.

In this case, even if the direction in which the first group of elongated holes extend is differed from the direction in which the second group of elongated holes extend, the first and second groups of holes can be distributed substantially uniformly as a whole over the substantially whole range or region of the perforated arcuate plate member.

According to a preferred embodiment of the present invention, the perforated cylindrical body comprises four perforated arcuate plate members each defining an outer periphery of the grain milling chamber through an angular range of about 90°, and resistance members extending in the vertical direction and provided between circumferentially adjacent edge portions of the four perforated arcuate plate members while being projected radially inwardly so as to impart a resistance to movement of grains in the circumferential direction of the roll assembly, an amount or magnitude of projection of the resistance members being adjustable.

According to another preferred embodiment of the present invention, the perforated cylindrical body comprises two perforated arcuate plate members each defining an outer periphery of the grain milling chamber through an angular range of about 180°, and resistance members extending in the vertical direction and provided between circumferentially adjacent edge portions of the two perforated arcuate plate members while being projected radially inwardly so as to impart a resistance to movement of grains in the circumferential direction of the roll assembly, an amount or magnitude of projection of the resistance members being adjustable.

The foregoing and other objects as well as features of the invention will be made clearer from the description hereafter of preferred embodiments of the invention with reference to drawings.

DESCRIPTION OF PREFERRED EMBODIMENTS

Now, taking a case of whitening rice grain as the grain, an abrasive type vertical rice whitening machine, which is a preferred embodiment of an abrasive type vertical grain milling machine according to the present invention, will be described with reference to FIGS. 1 to 3.

Figure 1:
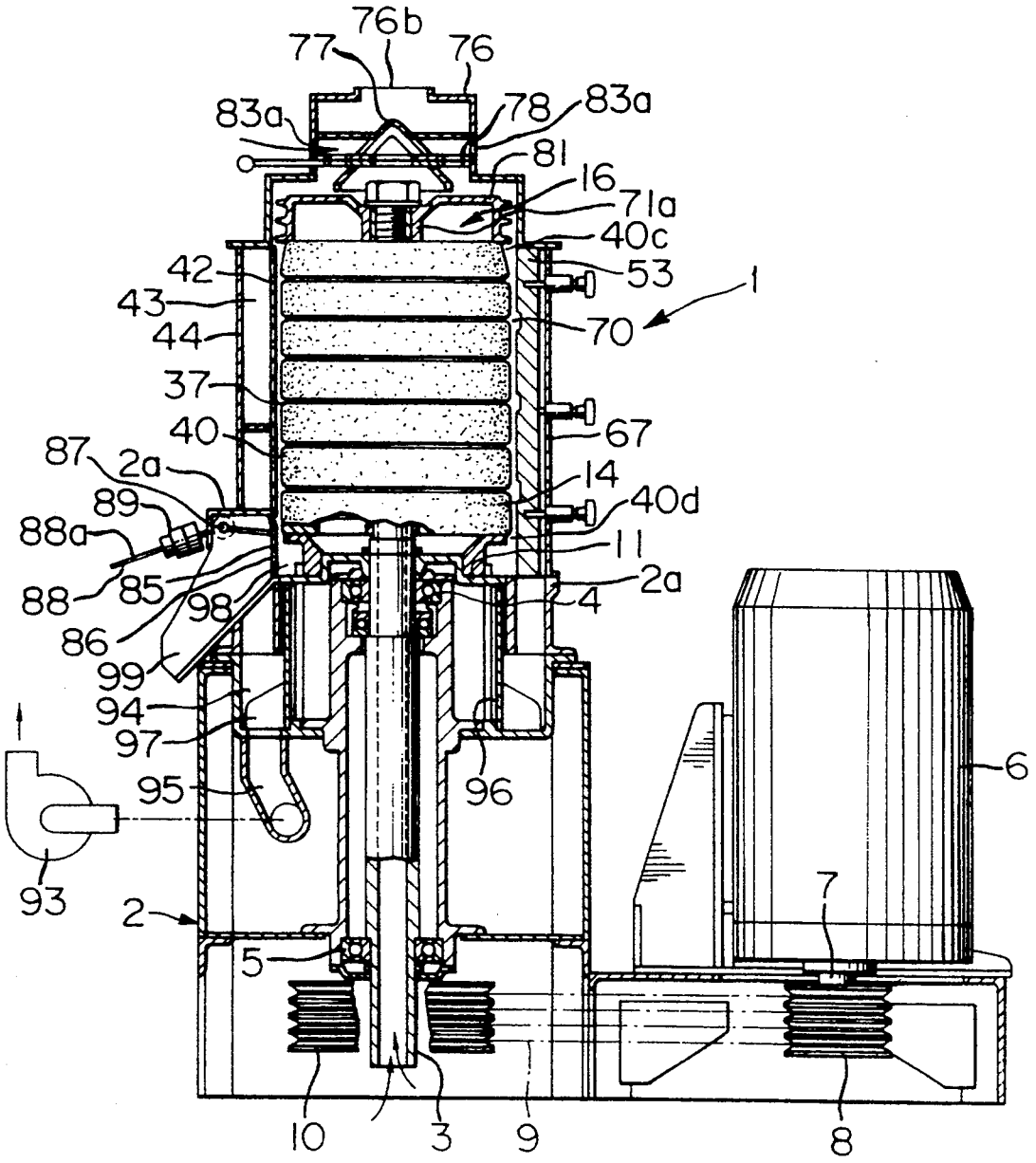
FIG. 1 is a vertical sectional view of an abrasive type vertical grain milling machine according to a preferred embodiment of the present invention (a sectional view of FIG. 3 taken along a line I—I)

In FIG. 1 showing generally a vertical sectional view of an abrasive type vertical rice whitening machine 1, reference numeral 2 denotes a base. In the central portion of the base 2, a main shaft 3 formed by a hollow shaft extending in the vertical direction is rotatably supported by means of upper and lower bearings 4 and 5. A motor 6 is equipped sidewards of the base 2 so that rotation of an output shaft 7 of the motor 6 is transmitted through a pulley 8, a wedge belt or V belt 9 and a pulley 10 to the main shaft 3, thereby making the main shaft 3 rotate at a suitable rotational speed (typically at a rotational speed that the speed of an abrasive type roll assembly 16 to be described later becomes about 600 m/min at the outer peripheral surface thereof).

Figure 2:
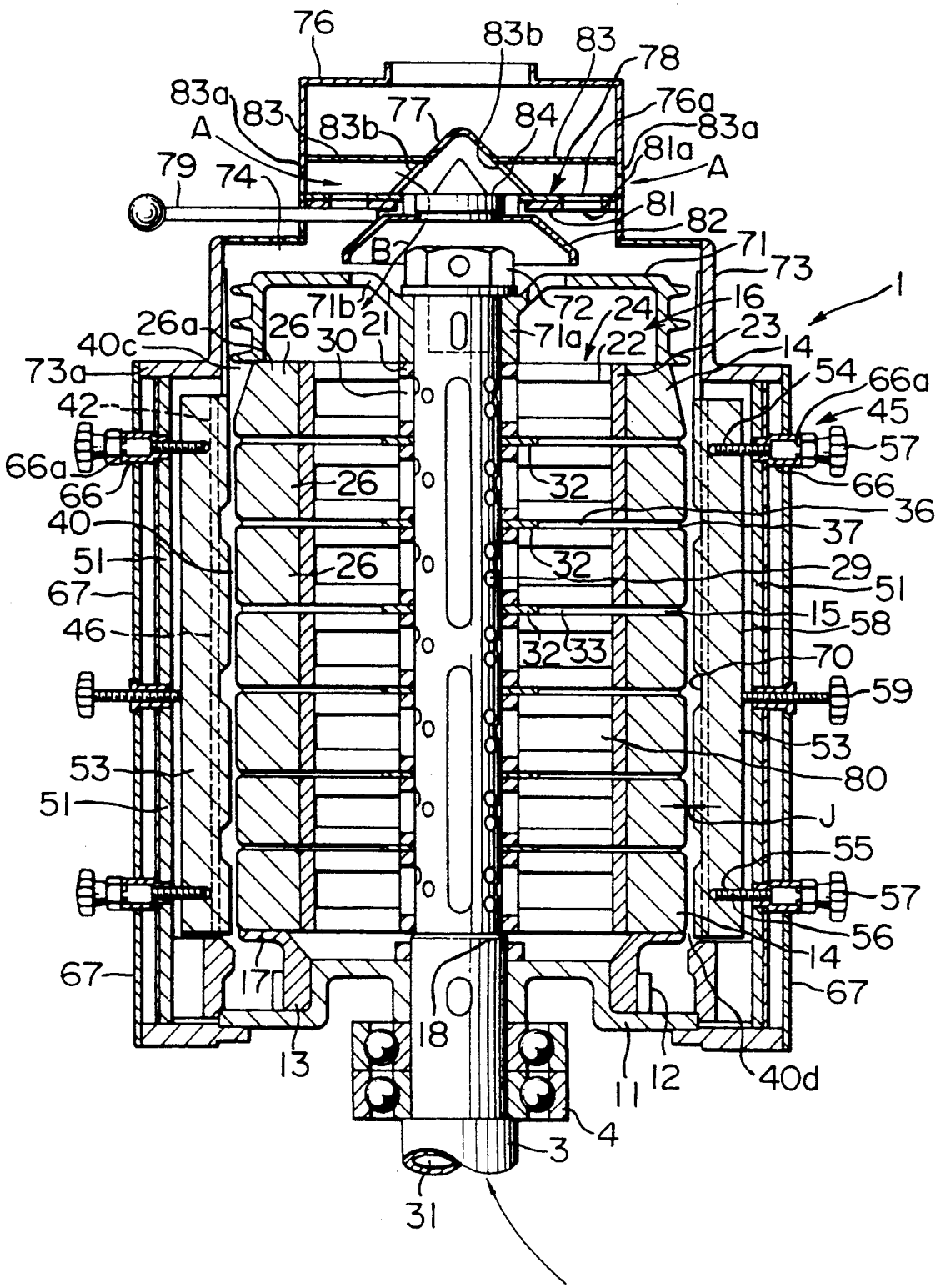
FIG. 2 is an enlarged sectional view for illustrating a part of the grain milling machine of FIG. 1.

As shown in FIG. 1 and FIG. 2 showing a part of FIG. 1 on an enlarged scale, a rotary bottom member 11 having a cap-like cross-section is fixed to the main shaft 3 such as to be positioned above the upper bearing 4, and a ring-like support member 13 formed with stirring blades 12 serving to discharge white rice grains, i.e. rice grains having been whitened or milled, is fixed to the rotary bottom member 11.

The ring-like support member 13 has a radially outward flange portion 17 on which is supported the bottom portion of the abrasive type roll assembly 16 constituted by a stack of multiple abrasive type roll elements 14 through roll element spacers 15. The abrasive type roll assembly 16 is supported by a stepped portion 18 of the main shaft 3 as well.

Figure 3:
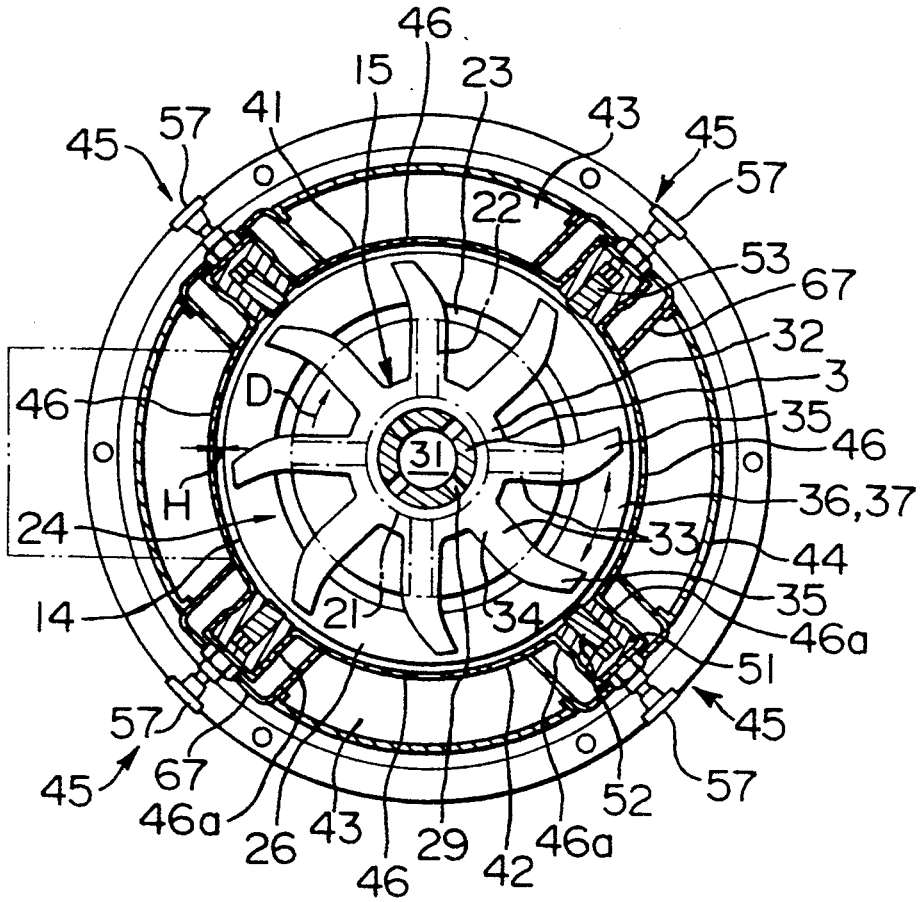
FIG. 3 is a cross-sectional view of the grain milling machine of FIG. 1 taken along the line III—III of FIG. 1.

Each roll element 14 comprises a rigid abrasive cylinder support member 24 including a boss portion 21 fitted on the main shaft 3, a plurality of arm portions 22 formed integrally with the boss portion 21 and extending radially outwardly from the boss portion 21 and a cylindrical portion 23 formed integrally with the extended ends of the arm portions 22, and an abrasive cylinder 26 securely fixed to the cylindrical portion 23 of the support member 24 and formed by an aggregate of emery particles (Carborundom (trademark)) (see FIG. 3 as well). Incidentally, as seen from FIG. 2, a length of the arm portion 22 in the vertical direction is smaller than axial lengths of the boss portion 21 and of the cylindrical portion 23. The axial length of the boss portion 21 is equal to that of the cylindrical portion 23.

Further, among the abrasive cylinders 26, the uppermost abrasive cylinder, that is, an abrasive cylinder 26*a* located on the most upstream side of the flowing direction of rice grains to be whitened, is formed in the shape of a circular truncated cone in order to guide the rice grains.

Moreover, the hollow main shaft 3 is formed with a large number of air holes 29 in a portion thereof where the abrasive type roll assembly is fitted on, and the boss portion 21 of the abrasive cylinder support member 24 of the roll element 14 is also formed therein with air holes 30 in portions thereof between the circumferentially adjacent arm portions 22 and 22. Accordingly, in case that the abrasive cylinder support member 24 of the roll element 14 is fitted on the hollow main shaft 3, the air holes 30 formed in the boss portion 21 are communicated with the air holes 29 formed in the main shaft 3, thereby enabling air to flow from an interior space 31 of the hollow main shaft 3 to an inside of the abrasive cylinder 26 through the air holes 29 and 30.

On the other hand, each of the roll element spacers 15 comprises, as shown in FIG. 3, a boss portion 32 having a larger diameter than the boss portion 21 and kept in contact at end faces thereof with end faces of the adjacent boss portions 21, and a plurality of arm portions 33 formed integrally with the boss portion 32 and extending substantially radially outwardly from the boss portion 32 and kept in contact with the end faces of the adjacent abrasive cylinder support members 24 so as to support the same. Each arm portion 33 comprises a base-side or proximal arm part 34 extending straight in the radial direction and a tapered distal end-side arm part 35 extending radially outwardly from the end of the base-side arm portion 34 as turning aside in a direction opposite to a direction D of rotation of the spacer 15.

Accordingly, the air having flown out from the interior space 31 of the hollow main shaft 3 to the inside of the abrasive cylinder 26 through the air holes 29 and 30 can flow out radially outwardly through between the adjacent roll elements 14 and 14 and through spaces 36 defined between the adjacent arm portions 33 and 33 of every roll element spacer 15. In other words, radially outward edge portions 37 of the spaces 36 serve as the bran-removing jet-air outlets of the abrasive type roll assembly 16.

Around the abrasive type roll assembly 16 is disposed a perforated cylindrical body 42, extending vertically leaving a space from the roll assembly 16, which cooperates with an outer peripheral surface of the roll assembly 16 to form or define a cylindrical grain milling chamber or a rice whitening chamber 40 around the roll assembly 16. The perforated cylindrical body 42 has a large number of holes or perforations 41 through which bran produced in the rice whitening chamber 40 is allowed to be released. Around the perforated cylindrical body 42 is disposed a cylindrical cover 44 which cooperates with the perforated cylindrical body 42 to define a bran-removing chamber 43 serving to collect and discharge the bran. Incidentally, the perforated cylindrical body 42 and the cylindrical cover 44 are set on and fixed to a support member 2*a* fixed to the base 2.

As shown in FIG. 3, the perforated cylindrical body 42 comprises four resistance imparting-adjusting mechanisms 45 disposed in such circumferential positions that the cylinder defined by the cylindrical body 42 is divided into four equal parts, and metallic perforated arcuate plate members 46 serving to define cylindrical surface portions between the adjacent resistance imparting-adjusting mechanisms 45 and 45.

Figure 4:
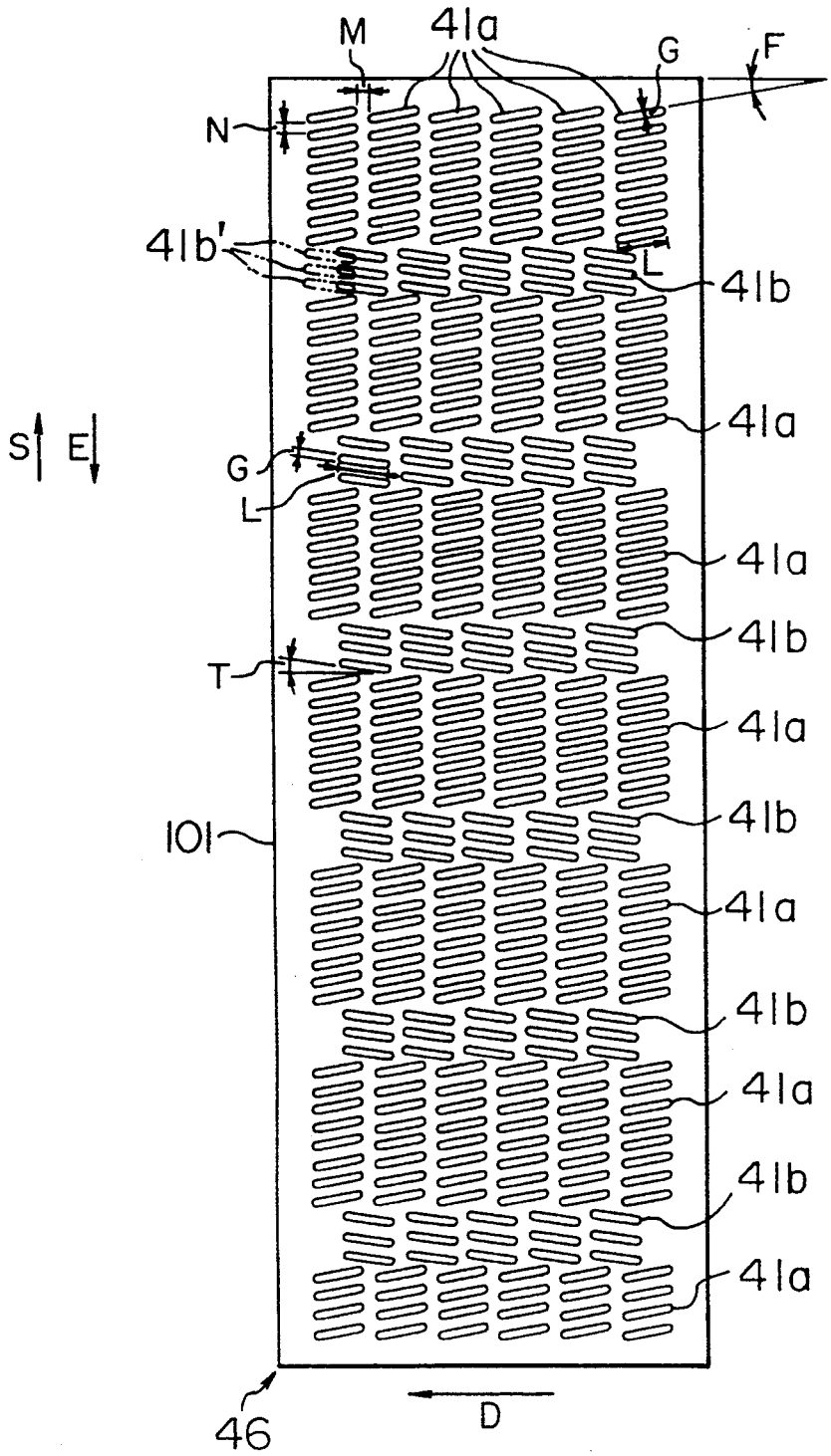
FIG. 4 is a developed plan view showing a perforated arcuate plate member (or a wire net or screen) used in the abrasive type grain milling machine according to a preferred embodiment of the present invention as viewed from outside.

The perforated arcuate plate members 46 each comprise, as shown in FIG. 4 which is a developed view thereof as viewed from an outside, an arcuate metallic plate 101 and first and second groups of elongated bran-removing holes 41*a* and 41*b* formed in the arcuate metallic plate 101 by means of punching, for example (in case of calling the first and second groups of holes 41*a* and 41*b*, as a whole, they are designated by the reference numeral 41 as made before).

The first group of bran-removing holes 41*a* are each formed such as to be inclined gradually downwards in the vertical direction E as going toward downstream side thereof in the direction D of rotation of the abrasive type roll assembly 16. This inclination of the first group of holes 41*a* has an effect of leading or guiding downwards in the direction E the rice grains which are being rotated in the direction D with the rotation of the abrasive type roll assembly 16. In other words, owing to this inclination, rice grain which is falling down in the direction E while being abraded by the abrasive type roll assembly 16 is led in the direction D of rotation of the abrasive type roll assembly 16. By varying this inclination angle F, it is possible to change the direction in which rice grain is to be led by the first group of holes 41*a*. The inclination angle F is about 10 degrees in the illustrated embodiment, and however, it may be either larger or smaller than this.

Further, a width G and a length L each of the elongated bran-removing holes 41*a* are 0.9 mm and 30 mm, respectively, in the illustrated embodiment, and however, if the width G is sufficiently smaller than a thickness of rice grain at the largest diameter portion thereof, there are no particular limitations to the width G and the length L. However, it is preferred that horizontal and vertical distances M and N between the adjacent holes 41*a* and 41*a* are equal to or larger than the width G of the hole 41*a* in order that the perforated arcuate plate member 46 can have a sufficient mechanical strength. Further, in the illustrated embodiment, the first group of holes 41*a* all have the same length L, the same width G and the same inclination angle F, and however, a part of the first group of holes 41*a* may be different from the other holes 41*a* in one of the length L, the width G and the inclination angle F.

The second group of bran-removing holes 41*b* are so formed as to give a lead or inclination reverse to that of the first group of bran-removing holes 41*a*. Namely, the second group of bran-removing holes 41*b* are each formed such as to be inclined gradually upwards in the vertical direction S, contrary to the first group of holes 41*a*, as going toward the downstream side thereof in the direction D of rotation of the abrasive type roll assembly 16. This inclination of the second group of holes 41*b* has an effect of leading or guiding upwards in the direction S the rice grains which are being rotated in the direction D with the rotation of the abrasive type roll assembly 16 so as to suppress the falling of rice grain in the direction E. In other words, this inclination serves to impart a resistance to the movement of rice grain in the direction D of rotation of the abrasive type roll assembly 16, which rice grain is falling down in the direction E while being abrade by the abrasive type roll assembly 16. Namely, the second group of holes 41*b* promote the stirring and turbulence of rice grains in the rice grain whitening chamber 40. By varying this inclination angle T, it is possible to change the substantial resistance with respect to the movement of rice grain partly dependent on the first group of holes 41*a*. In the illustrated embodiment, the inclination angle T, i.e. a magnitude thereof, of the holes 41*b* is equal to the inclination angle F of the holes 41*a*, and however, the angle T may be either larger or smaller than the angle F.

In the illustrated embodiment, the width G and the length L of the second group of bran-removing holes 41*b* are equal to the width and length of the first group of bran-removing holes 41*a*, and however, at least one of the width and length of the second group of holes 41*b* may be either larger or smaller than the width and length of the first group of holes 41*a*. Further, in the illustrated embodiment, the second group of holes 41*b* all have the same length, the same width and the same inclination angle, and however, a part of the second group of holes 41*b* (the holes in the upper part in the vertical direction, for example) may be different from the other holes (the holes in the lower part in the vertical direction, for example) in one of the length L, the width G and the inclination angle T.

In the illustrated embodiment, the second group of bran-removing holes 41*b* are arranged between the first group of holes 41*a* as being collected three by three in the vertical direction, and however, so far as the number of the second group of holes 41*b* is considerably smaller than that of the first group of holes 41*a*, the number of the second group of holes 41*b* which are to be arranged as being collected in the vertical direction may be either not greater than three or not smaller than four. By varying a ratio or proportion of the number of the second group of holes 41*b* to the number of the first group of holes 41*a*, it is possible to change the substantial resistance to the movement of rice grain. Further, the ratio or proportion of the number of the second group of holes 41*b* to the number of the first group of holes 41*a* in a certain range can be varied in the vertical direction such that, for example, it becomes larger or smaller as going toward vertically lower part.

In order that bran-removing passages formed by the holes 41*a* and 41*b* are spatially distributed as uniformly as possible over the cylindrical body 42, the second group of holes 41*b* are located between the first group of holes 41*a* and 41*a* as viewed in the horizontal direction (or at the positions offset in the horizontal direction from the lines of the first group of holes 41*a* as viewed in the vertical direction) in the embodiment of FIG. 4. However, the second group of holes 41*b* may be formed, if desired, at the positions where they are aligned with the first group of holes 41*a* in the vertical direction as shown by imaginary lines 41*b*' in FIG. 4 in so far as not to reduce bran-removing efficiency considerably.

Figure 5:
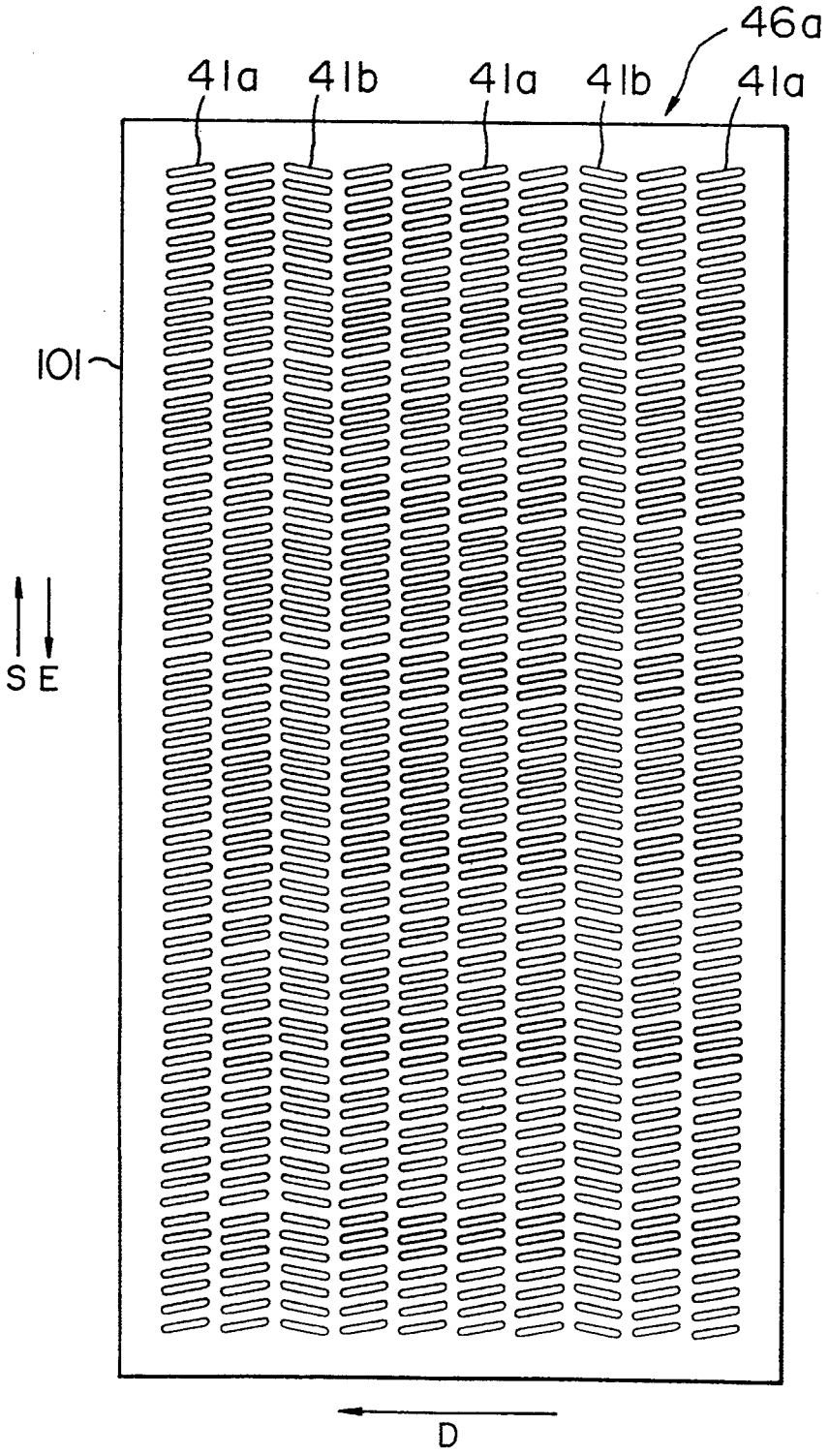
FIG. 5 is a plan view similar to FIG. 4 but showing a modification of the perforated arcuate plate member.

Moreover, as shown in FIG. 5, the second group of holes 41*b* may be aligned in the vertical direction. In this case, the bran-removing passages formed by the holes 41*a* and 41*b* can be also distributed spatially uniformly. Incidentally, FIG. 5 shows the case that two perforated arcuate plate members 46*a* are used to form a cylinder, that is, the case that the resistance imparting-adjusting mechanisms 45 shown in FIG. 3 are disposed at angular intervals of 180 degrees. However, the vertical arrangement of the second group of holes 41*b* shown in FIG. 5 can be also applied to the case that each arcuate plate member 46 covers the angular range of about 90 degrees as shown in FIG. 4. In the case of FIG. 5, the number of the second group of holes 41*b* is a quarter of the number of the first group of holes 41*a*, and however, the ratio or proportion of the number of the second group of holes 41*b* to the number of the first group of holes 41*a* may be either larger or smaller than this value as mentioned before.

Further, as seen from FIG. 2, the flow resistance imparting-adjusting mechanisms 45 and the perforated arcuate plate members 46 are respectively formed to extend over the entire vertical length of the rice whitening chamber 40. A distance H between the inner peripheral surface of the perforated plate member 46 and the outer peripheral surface of the abrasive roll element 14 is in the range of about 10–15 mm, for example. The distance H is in a certain range that enables the grain to roll over when subjected to the abrasive action and is decided in accordance with various factors such as the kind of grain to be milled, average size of emery particles of the abrasive roll element 14, and rotational speed of the abrasive roll element 14.

Each flow resistance imparting-adjusting mechanism 45 comprises a stanchion or support post 51 of a substantially U-letter form cross-section extending in the vertical direction, a prismatic resistance claw 53 fitted disengageably in a concave portion 52, which extends in the vertical direction of "U" of each stanchion 51 and opens radially inwardly, so as to serve as a resistance member, knob bolts 57, 57 screwed in upper and lower tapped holes 54 and 55 of the resistance claw 53 at an external thread portion 56 thereof for serving to adjust the radial position of the resistance claw 53 with respect to the stanchion 51 (in other words, a distance J between the resistance claw 53 and the abrasive roll element 14), and a set bolt 59 screwed in a tapped hole of the stanchion 51 for serving, in adjusting the position of the resistance claw 53, to fix the resistance claw 53 with respect to the stanchion 51 by making the tip end thereof come in contact with an outside end face 58 of the resistance claw 53.

Further, each perforated arcuate plate member 46 is fixed at circumferential end or edge portion 46*a* thereof to the side wall of the stanchion 51 associated therewith. On the other hand, the stanchion 51 is fixed to the bran-removing chamber cover 44 through a stanchion cover 67. The knob bolt 57 is prohibited from displacing in the axial direction thereof with respect to the stanchion 51 by means of a bolt retainer 66 fixed to the stanchion 51 and engaged with an annular groove of the knot bolt 57 at a caulking end portion 66*a* thereof.

Moreover, as designated by reference numeral 70 in FIGS. 1 and 2, in order to avoid jet-air outlets 37 and the vicinity thereof from being clogged with rice grain(s), a groove may be formed in the resistance claw 53 in some (or every) portion thereof facing on the jet-air outlet 37.

Reference numeral 71 denotes a hollow bottomless feed roll having a feed screw formed in the outer peripheral surface thereof. The feed roll 71 is set on the uppermost roll element 14 by fitting a boss portion 71*a* thereof on the main shaft 3 and securely fixed to the main shaft 3 together with the abrasive roll assembly 16 by means of a bolt 72 screwed in a tapped hole formed in the upper end of the main shaft 3. Further, reference numeral 73 denotes a feed cylinder which forms a supply chamber 74 of rice grain to be whitened in cooperation with the feed roll 71, and a flange portion 73*a* at the lower end of the feed cylinder 73 is set on and fixed to the upper end of the stanchion 51 and the cylindrical cover 44 as a part of the frame of the rice whitening machine 1.

In addition, reference numeral 76 denotes a hopper into which rice grain to be whitened is thrown, 77 denotes an upper rice grain guide member formed in the shape of a hollow cone, and 78 denotes a feed amount regulating gate. The gate 78 is manually operated by a handle 79 to adjust a position of a movable plate 81 with an opening 81*a* with respect to a bottom opening 76*a* of the hopper 76, so that the amount of rice grain to be fed from the hopper 76 into the supply chamber 74 is regulated or controlled. Reference numeral 82 denotes a lower guide member formed in the shape of a circular truncated cone and serving to feed rice grain introduced through the gate 78 into the supply chamber 74 while dispersing the same.

Moreover, the hopper 76 is provided with suction pipes 83 extending radially at equal angular intervals and serving to induce or introduce air for bran-removing or the like. Each suction pipe 83 is opened in the peripheral wall of the hopper 76 at one end 83*a* thereof, while it is opened in the wall portion of the upper guide member 77 at the other end 83*b* thereof. Accordingly, air induced through the openings 83*a* in the direction of arrow mark A is made to flow through the suction pipes 83 and the hollow upper guide member 77, enter into a central opening 84 of the lower guide member 82, further flow through within the lower guide member 82 and an upper opening 71*b* of the feed roll 71 and, then, enter into an interior space 80 of the abrasive roll assembly 16, as indicated by an arrow mark B.

Reference numeral 85 denotes a resistance board provided at a discharge port 86 through which rice grain having been whitened in the rice whitening chamber 40 is discharged. The pressing force applied to the rice grains in the rice whitening chamber 40 by the resistance board 85 is defined or controlled by adjusting a position of a weight 89 screwed to one arm 88*a* of a lever 88 supported by a pivoted shaft 87.

Reference numeral 93 denotes a bran-collecting fan which serves to release through an exhaust pipe 95 bran collected in a bran-collecting chamber 94 formed at the bottom of the bran-removing chamber 43. Incidentally, a bottom cylindrical member 96 defining the inner peripheral wall of the bran-collecting chamber 94 is fixed to the rotary bottom member 11, and the bottom cylindrical member 96 is provided with scraping blades 97 serving to promote the discharge of the bran from the bran-collecting chamber 94 when the bottom cylindrical member 96 is rotated together with the lower rotary bottom member 11.

Next, description will be given of handling and operation of the rice whitening machine 1 thus constructed, which is a preferred embodiment of the abrasive type vertical grain milling machine according to the present invention, with reference to FIGS. 1 to 4.

First, the rice whitening conditions of the abrasive type vertical rice whitening machine 1 are set and adjusted in accordance with the characteristic or properties of rice grains to be whitened.

More specifically, in accordance with various properties such as the shape of grain determined by the sizes of rice grains in both directions of long (major) and short (minor) axes thereof before and after rice whitening, the thickness and hardness of surface layer of rice grain to be removed by the rice whitening machine 1, the radial positions of the resistance claws 53 are adjusted by handling the knob bolts 57 and the set bolts 59 while considering the diameter and rotational speed of the abrasive roll assembly 16, the abrasive characteristic of the abrasive roll element 14, the bran-removing characteristic of the bran-removing system including the exhaust fan 93 and so on. Incidentally, after observing the rice grain having been whitened and discharged, readjustment is made if necessary.

On the other hand, by adjusting the position of the weight 89 on the lever 88*a*, the pressing force resulting from the resistance board 85, that is, the pressure applied to rice grains in the rice whitening chamber 40 by the resistance board 85 is regulated. Incidentally, this pressure regulation may be performed during the rice whitening as well.

After the initialization described above, rice grains to be whitened is thrown into the hopper 76 through an inlet 76*b* as the gate 78 is being closed and, at the same time, the motor 6 is started to rotate the abrasive roll assembly 16 and the feed roll 71 through the main shaft 3, with a result that the bran-collecting fan 93 is started so as to begin blowing of air for bran-removing.

Subsequently, the handle 79 is operated to open the feed amount regulating gate 78 so that rice grains to be whitened are started to be introduced into the supply chamber 74 from the hopper 76. In this case, rice grain are supplied continuously into the supply chamber 74 as being dispersed uniformly in the circumferential direction by means of the upper and lower guide members 77 and 82. Rice grains received in the supply chamber 74 are fed continuously to an upper end 40*c* of the rice whitening chamber 40 by means of the feed roll 71.

In the steady state of the rice whitening operation of the rice whitening machine 1, rice grains supplied in the rice whitening chamber 40 come downwards gradually while rolling and rotating or revolving (or moving around the main shaft in circular motion) violently under the relatively low pressing force between the stationary perforated cylindrical body 42 and the rotating abrasive roll assembly, during which the surface of rice grain is made to come in contact with the abrasive cylinder 26 of the roll element 14 of the abrasive roll assembly 16 so as to be scraped off or abraded by the abrasive cylinder 26. In this case, rice grain is guided in the direction D of the abrasive type roll assembly 16 as well as in the downward direction E by means of the first group of holes 41*a* formed in the perforated arcuate plate members 46 of the perforated cylindrical body 42 as well.

In more detail, since rice grain is caught between the resistance claw 53 and the abrasive roll assembly 16 when it reaches the resistance claw 53, the rotating speed thereof is reduced under the influence of braking action and a large difference comes out between the rotating (revolving) speed thereof and the rotational speed of the abrasive roll assembly 16, with a result that the surface of rice grain is scraped off or abraded by being rubbed intensively with the emery particles of the abrasive cylinder 26 of the roll assembly 16. Further, since the resistance claws 53 each have the function of braking intermittently the general or collective flow of rice grains in the rice whitening chamber 40, the rolling speed and the rotating speed of rice grain in the rice whitening chamber 40 are changed intermittently, with a result that the rice whitening proceeds gradually. Moreover, since the relation between the rolling speed and the rotating or revolving speed of rice grains can be changed delicately by the adjustment of the resistance claws 53, the shape of rice grains to be discharged after whitening can be also changed by making use of this relation. Further, in this case, the second group of bran-removing holes 41*b* in the perforated arcuate plate members 46 of the perforated cylindrical body 42 serve as the resistance to the flow of rice grains over the almost whole angular range within the rice whitening chamber 40 and tend to push up in the direction S the rice grain which is being rotated in the direction D, and therefore, stirring of rice grains in the rice whitening chamber 40 is promoted to provide uniform distribution, with a result that rice whitening can proceed uniformly in the rice whitening chamber 40.

In addition, since the predetermined exit pressure is applied to the rice whitening chamber 40 by the resistance board 85 which receives the force due to the weight 89, upon whitening the rice grains in the aforementioned manner, rice grains are abraded to be whitened in the state that they are filled in the rice whitening chamber 40 at an appropriate density so far as rice grains are allowed to flow continuously.

Rice grains having been whitened are collected in a collector portion 98 below the lower end 40*d* of the rice whitening chamber 40. The rice grains in the collector portion 98 are discharged through a chute 99 by opening the bottom resistance board 85 against the pressing force of the weight 89 while being stirred by the rotary stirring blades 12 attached to the lower rotary bottom member 11.

Meanwhile, as the fan 93 is operated, air is exhausted through the exhaust pipe 95. Therefore, on the one hand, air is induced from the openings 83*a* in the side wall of the hopper 76 into the interior space 80 of the abrasive roll assembly 16 via the suction pipes 83, the interior space of the upper guide member 77, the opening 84, the interior space of the lower guide member 82, the upper opening 71*b* of the feed roll 71, and the interior space of the feed roll 71, while, on the other hand, air is induced from the inside passage 31 of the main shaft 3 to the interior space 80 of the abrasive roll assembly 16 through the air holes 29 and 30. Air flown into the interior space 80 of the abrasive roll assembly 16 is blown off into the rice whitening chamber 40 through the portions 37 located at the radially outer end portions of the jet-air spaces 36 defined between the adjacent arm portions 33, 33 of each spacer 15 and between the adjacent abrasive cylinders 26, 26 of the roll elements 14, 14, that is, through the relatively large jet-air outlets 37. Air having been jetted into the rice whitening chamber 40 is accompanied with bran and other powdered matter present in the rice whitening chamber 40 when it is jetted out through the holes 41 of the perforated cylindrical body 42 into the bran-removing chamber 43, and therefore, bran and other powdered matter in the rice whitening chamber 40 can be discharged to the bran-removing chamber 43.

The stream of air within the rice whitening chamber 40 not only promotes the stirring of rice grains in the chamber 40 but also suppresses the rise of temperature of rice grains in the rice whitening chamber 40. Further, since the resistance claw 53 is formed with the concave portion 70, there is little possibility that the jet-air outlet 37 is clogged with rice grain(s), bran and the like, even through the resistance claws 53 are provided. The bran having been introduced in the bran-removing chamber 43 is collected in the bran-collecting chamber 94 and scraped out by the scraping blades 97. Moreover, the grain(s) and/or bran which tends to enter into the depth of the jet-air outlet 37 can be returned to the rice whitening chamber 40 due to the centrifugal force resulting from the rotation of the arm 33 as well.

EXAMPLE

Figure 6:
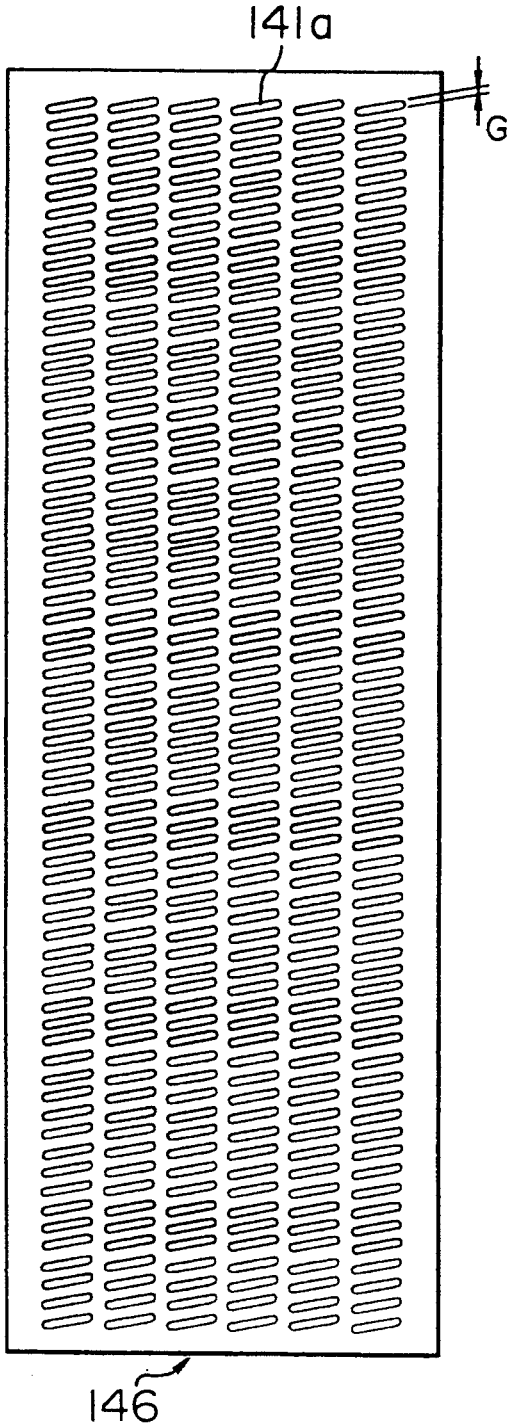
FIG. 6 is a plan view similar to FIG. 4 but showing a conventional perforated arcuate plate member.

Now, description will be given of the results of rice whitening test or experiment having been conducted in the rice whitening machine according to a preferred embodiment of the present invention which is shown in FIGS. 1 to 4 (that is, the rice whitening machine comprising the perforated cylindrical body 42 having the perforated arcuate plate members 46 shown in FIG. 4) and in a comparative rice whitening machine having the same construction except that conventional perforated arcuate plate members 146 shown in FIG. 6 are used in place of the perforated arcuate plate members 46 shown in FIG. 4.

The rice whitening test was conducted under the following conditions.

(1) Raw husked rice fed into the hopper 76, that is, rice grains to be whitened by the rice whitening machine were of "Basmati" variety, containing 10.3% broken rice grains and having been milled to a whiteness degree of 20.6%.

(2) Each wire net or perforated arcuate plate member 46 of the test machine was formed therein with the second group of bran-removing holes **41*b* that were arranged in six horizontal lines each having five horizontal sets of three holes arranged vertically as shown in FIG. 4. On the other hand, each perforated arcuate plate member 146 of the comparative machine was formed therein only with bran-removing holes 141*a* which were the same as the first group of bran-removing holes 41*a*, as shown in FIG. 6**.

(3) Each wire net, that is, each of the perforated arcuate plate member 46 of the test machine and the perforated arcuate plate member 146 of the comparative machine was formed with the bran-removing holes of mesh width or width G=0.9 mm and length L=30 mm. More specifically, each of the first and second bran-removing holes **41*a* and 41*b* of the perforated arcuate plate member 46 of the test machine was 0.9 mm in width G and 30 mm in length L, and each of the bran-removing holes 141*a* of the perforated arcuate plate member 146** of the comparative machine was also 0.9 mm in width G and 30 mm in length L.

(4) A milling rate or ratio was 50%. Namely, although about 10% by weight of the raw husked rice grains is removed in an ordinary rice whitening operation, 50% thereof was removed by rice whitening finally in this test. In other words, by this rice whitening, 5% (=10%×0.5) by weight of the raw husked rice grains was removed as the bran through the bran-removing chamber 43 and the bran-collecting chamber 94, while the remaining 95% was taken out from the chute 99 as white rice. The degree of whiteness of the obtained white rice grains was 25.8%.

The results of this rice whitening test are as follows.

(1) In the case of the comparative rice whitening machine equipped with the conventional perforated arcuate plate members 146, ratio or proportion of broken rice with respect to the white rice taken out from the chute 99 was 16.6% by weight. While in the case of the rice whitening machine according to a preferred embodiment of the present invention equipped with the perforated arcuate plate members 46 (test machine), the ratio or proportion of broken rice was 15.9% by weight of the white rice taken out from the chute 99, resulting in that the percentage of broken rice was reduced by 0.7 point as compared with the case of the comparative machine.

(2) Further, a percentage of the bran-removed through the bran-removing chamber 43 and the bran-collecting chamber 94 was 12.7% in the case of the comparative rice whitening machine equipped with the conventional perforated arcuate plate members 146, while it was 12.8% in the case of the rice whitening machine according to a preferred embodiment of the present invention equipped with the perforated arcuate plate members 46 (test machine), resulting in that the percentage of bran was evaluated as substantially the same.

(3) From the results of the above items (1) and (2), it is apparent that, in the case of the test machine, although the percentage of broken rice discharged as bran was substantially equal to that in the case of the comparative machine, the percentage of broken rice grains contained in the rice grains taken out as the white rice was reduced.

(4) In other words, the percentage of broken rice was increased by 6.1 points (=95×0.166+5×0.127−10.3) in the case of the comparative test machine, while, in the case of the test machine of the invention, the percentage of broken rice was increased only by 5.4 points, with a result that the yield of rice grains taken out as the white rice without been broken could be enhanced.

Namely, from the above description about the rice whitening test using the test machine and the comparative test machine, it is seen that the yield of white rice grains remaining without being broken at the time of rice whitening can be enhanced in the present invention.

Figure 7:
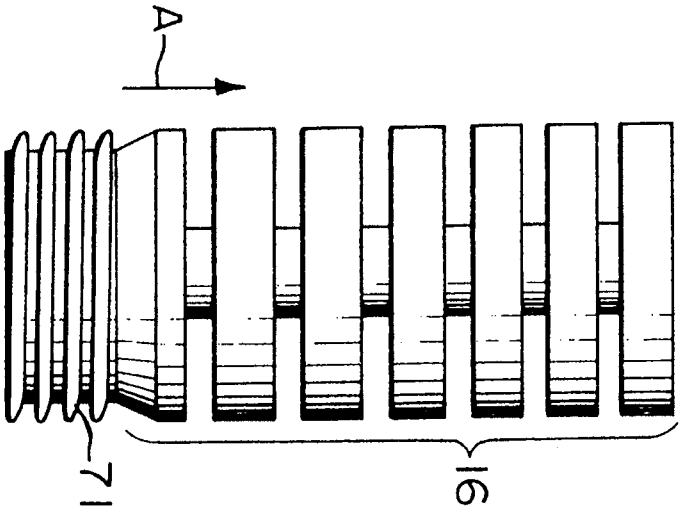
FIG. 7 is a view for illustrating the relation between an abrasive roll assembly and a feed roll in a modification of the abrasive type vertical grain milling machine of FIG. 1.

The above description has been made as to the case that rice grain is whitened while being made to flow from the top to the bottom, and however, an abrasive type vertical rice whitening machine of a lift type is also available in which the feed roll 71 is disposed below the abrasive roll assembly 16 so that rice grains are whitened while being made to flow from the bottom to the top in the direction of an arrow mark A as shown in FIG. 7. In this case, the first and second groups of bran-removing holes **41*a* and 41*b*** are made to be inclined in the directions reverse to those of the aforementioned embodiment.

The grain to be milled may be other grain such as wheat grain in place of rice grain. In this case, the grain milling conditions of the grain milling machine are changed in accordance with the grain size as well as with the thickness, hardness and the like of the surface layer to be removed which depend on the difference in the kind of grains.

Moreover, the above-described embodiment has been described as having two airflow passages as ventilating means, that is, the air flow passage leading from the openings **83*a* in the side wall of the hopper 76 to the interior space 80 of the abrasive roll assembly 16 through the suction pipes 83 and the like and the airflow passage leading from the inside passage 31 to the interior space 80 of the abrasive roll assembly 16 through the air holes 29, 30 or the main shaft 3**, and however, it will do as well that either one of these airflow passages is provided.

What is claimed is:

1. An abrasive type vertical grain milling machine in which grain to be milled is introduced into a cylindrical grain milling chamber from vertical one end of said grain milling chamber and grain having been milled is discharged from the other end of the same, said grain milling machine comprising:

an abrasive type grain milling roll assembly mounted on a main shaft extending straight in the vertical direction; and a perforated cylindrical body extending vertically around said roll assembly leaving a space therefrom so as to form said cylindrical grain milling chamber around said roll assembly in cooperation with an outer peripheral surface of said roll assembly and having a large number of bran-removing holes through which bran produced in said grain milling chamber is allowed to be released, wherein said cylindrical body comprises at least one perforated arcuate plate member having said bran-removing holes therein, and said bran-removing holes include a first group of elongated bran-removing holes which serve to lead the grain to be milled in a direction from said one end toward said other end of said grain milling chamber when said grain is rotated in a direction of rotation of the grain milling roll assembly within the grain milling chamber and a second group of elongated bran-removing holes which serve to lead the grain to be milled in a direction from said other end toward said one end of said grain milling chamber when said grain is rotated in the direction of rotation of the grain milling roll assembly within the grain milling chamber.

2. An abrasive type vertical grain milling machine according to claim 1, wherein each of the first group of elongated bran-removing holes is formed to extend inclinedly along a first leading direction so as to lead the grain to be milled in the direction from said one end toward said other end of said grain milling chamber when said grain is rotated in the direction of rotation of the grain milling roll assembly within the grain milling chamber, while each of the second group of elongated bran-removing holes is formed to extend inclinedly along a second leading direction different from said first leading direction so as to lead the grain to be milled in the direction from said other end toward said one end of said grain milling chamber when said grain is rotated in the direction of rotation of the grain milling roll assembly within the grain milling chamber.

3. An abrasive type vertical grain milling machine according to claim 1, wherein number of said second group of holes is considerably smaller than that of said first group of holes.

4. An abrasive type vertical grain milling machine according to claim 1, wherein said second group of holes are distributed between said first group of holes as being collected by plural holes.

5. An abrasive type vertical grain milling machine according to claim 4, wherein said second group of holes are distributed between said first group of holes as being collected three by three in the vertical direction.

6. An abrasive type vertical grain milling machine according to claim 2, wherein one or more vertical lines of said second group of holes are distributed between associated vertical lines of said first group of holes.

7. An abrasive type vertical grain milling machine according to claim 1, wherein said perforated cylindrical body comprises four perforated arcuate plate members each defining an outer periphery of the grain milling chamber through an angular range of about 90°, and resistance members extending in the vertical direction and provided between circumferentially adjacent edge portions of said four perforated arcuate plate members while being projected radially inwardly so as to impart a resistance to movement of grains in the circumferential direction of said roll assembly, an amount of projection of said resistance members being adjustable.

8. An abrasive type vertical grain milling machine according to claim 1, wherein said perforated cylindrical body comprises two perforated arcuate plate members each defining an outer periphery of the grain milling chamber through an angular range of about 180°, and resistance members extending in the vertical direction and provided between circumferentially adjacent edge portions of said two perforated arcuate plate members while being projected radially inwardly so as to impart a resistance to movement of grains in the circumferential direction of said roll assembly, an amount of projection of said resistance members being adjustable.

* * * * *